US008323012B2

(12) United States Patent
Edwards

(10) Patent No.: US 8,323,012 B2
(45) Date of Patent: Dec. 4, 2012

(54) CONTROLLED-CLEARANCE SEALING COMPRESSOR DEVICES

(76) Inventor: Thomas C. Edwards, Rockledge, FL (US)

( * ) Notice: Subject to any disclaimer, the term of this patent is extended or adjusted under 35 U.S.C. 154(b) by 112 days.

(21) Appl. No.: 12/818,628

(22) Filed: Jun. 18, 2010

(65) Prior Publication Data

US 2010/0304262 A1 Dec. 2, 2010

Related U.S. Application Data

(60) Division of application No. 11/219,481, filed on Sep. 2, 2005, now Pat. No. 7,740,460, which is a continuation-in-part of application No. 11/198,773, filed on Aug. 5, 2005, now Pat. No. 7,491,037.

(51) Int. Cl.
*F01C 19/00* (2006.01)

(52) U.S. Cl. ..... 418/261; 418/31; 418/106; 418/265; 417/312

(58) Field of Classification Search ..... 417/312, 417/315; 418/24–27, 30–31, 106, 264–265, 418/140, 145, 146, 261
See application file for complete search history.

(56) References Cited

U.S. PATENT DOCUMENTS

| | | | | |
|---|---|---|---|---|
| 3,807,912 | A * | 4/1974 | Keller | 418/31 |
| 4,111,618 | A | 9/1978 | Thibault | |
| 5,087,183 | A | 2/1992 | Edwards | |
| 5,160,252 | A | 11/1992 | Edwards | |
| 5,181,414 | A * | 1/1993 | Baret et al. | 73/40.7 |
| 5,374,172 | A | 12/1994 | Edwards | |
| 6,371,745 | B1 | 4/2002 | Bassine | |
| 6,503,071 | B2 * | 1/2003 | Edwards | 418/151 |
| 6,623,261 | B2 | 9/2003 | Edwards | |
| 7,114,932 | B1 | 10/2006 | Bassine | |
| 7,344,361 | B2 | 3/2008 | Kiefer | |
| 2002/0068003 | A1 | 6/2002 | Edwards | |
| 2002/0092316 | A1 | 7/2002 | Kidwell | |
| 2003/0021713 | A1 * | 1/2003 | Edwards | 418/106 |

FOREIGN PATENT DOCUMENTS

JP 2006083767 3/2006

* cited by examiner

*Primary Examiner* — Charles Freay
*Assistant Examiner* — Patrick Hamo
(74) *Attorney, Agent, or Firm* — Brian S. Steinberger; Phyllis K. Wood; Law Offices of Brian S. Steinberger, P.A.

(57) ABSTRACT

A controlled-clearance sealing compressor device that provides precision rotor centering directly with respect to the stator housing, vane centering with respect to rotor (not the stator) and the dynamic balance design of the gliders required for practical single and dual vane devices. The devices uses roller bearings to control the radial position of the vane and control rods or pins are used to control axial positioning of the vane, its 'centralization' with respect to the rotor and the endplates. The positive displacement rotary vane compressors and vacuum pumps have friction reduction, efficiency enhancement and exceedingly long operating life as a result of the non-contact gas sealing of the process gas within the rotary vane compressors and vacuum pumps. In an embodiment the positive displacement compressing device is used in transportation vehicles.

13 Claims, 12 Drawing Sheets

30
60
62
64
80
70
20
150
40
44
42
100
90
56
52
50
10
2X
103
54
72
110

251
250
263
262
261
257
277
275
276

CONTROLLED-CLEARANCE SEALING COMPRESSOR DEVICES

This is a Divisional of Application of Ser. No. 11/219,481 filed on Sep. 2, 2005, now U.S. Pat. No. 7,740,460 titled "Controlled-Clearance Sealing Compressor Devices" which is a continuation-in-part of U.S. patent application Ser. No. 11/198,773 filed on Aug. 5, 2005 titles: "Reversible Valving Systems for Use in Pumps and Compressing Devices " now U.S. Pat. No. 7,491,037.

FIELD OF THE INVENTION

This invention relates to positive displacement rotary vane compressors and vacuum pumps and, in particular, to methods, systems, apparatus and devices that provide a mechanically-governed, positive-displacement, non-contact sealing compression or vacuum device that uses roller bearings to control the radial position of the vane and uses control rods or pins to control the axial position of the vane with respect to the rotor and the endplates.

BACKGROUND AND PRIOR ART

U.S. Pat. No. 5,087,183, issued on Feb. 11, 1992 to Edwards, the applicant of the present patent application, and entitled "Rotary Vane Machine with Simplified Anti-Friction Positive Bi-Axial Vane Motion Control" discloses a means for constraining, in a precision fashion, the circumferential motion of the vane so that the tip of the vane does not engage the inner bore of the stator housing, but is close enough to provide adequate gas sealing. Machines produced according to the '183 patent have significantly less friction than conventional contact vane machines. The Edwards '183 patent also discloses the use of roller bearings as the anti-friction element and includes use of one, two or three vanes.

Vane centering (attaining accurate axial positioning to avoid side contact between the vane ends and the stator endplates) is easily achieved through the use of ball bearings as taught, for example, in U.S. Pat. No. 5,374,172, issued on Dec. 20, 1994 to Edwards, and entitled "Rotary UniVane Gas Compressor." Further, axially positioning through the use ball bearings is commonly used in both alternating and direct current electric motors as well as in contact-sealing vane compressors. Also made of record is U.S. Pat. No. 5,160,252 issued on Nov. 3, 1992 which is a continuation-in-part of the '183 patent.

In prior art multiple vane machines, the radial and tangential velocities of the vanes are constantly varying with respect to one another and, thus require the use of special segmented bearings that allow each vane to vary in speed independent of the other vanes. U.S. Pat. No. 5,374,172 issued on Dec. 20, 1994 to Edwards, discloses a single rotating vane machine. Unlike multi-vane machines of the prior art at the time, conventional dual race bearings are used to control the radial non-contact location of the single vane. Additionally, means are provided for dynamically balancing the rotating rotor and vane. Machines produced according to the '172 patent are characterized by having very low mechanical friction and excellent gas sealing, and are hence, very energy efficient.

U.S. Pat. No. 6,503,071 issued on Jan. 7, 2003 to Edwards, discloses a high-speed UniVane® fluid-handling device. This single vane gas displacement apparatus comprises a stator housing with a right cylindrical bore enclosing an eccentrically mounted rotor which also has a radial slot in which is movably radially positioned a single vane. The vane is tethered to antifriction vane guide assemblies concentric with the housing bore. Then vane has a pre-selected center of gravity located proximate to the housing bore axis. An option is to have a port in the vane for ducting high-pressure gas to the inlet side to react against the rotor slot to reduce vane contact therewith.

U.S. Pat. No. 6,623,261 issued on Sep. 23, 2003, also to Edwards, discloses a single-degree-of-freedom controlled-clearance UniVane® fluid-handling machine. In this patent, the rotor has a rotational axis and carries at least one vane which is supported by a vane guide apparatus for rotation about a stator axis which is spaced from the rotor axis a preselected amount and where both the rotor and vane have axial flat surfaces which are rotated adjacent to stationary flat surfaces of a stator or stator endplates. The patent discloses a provision for axial adjustment of the vane with respect to the flat surface of the stator endplates and independently provides an adjustment of the rotor end surfaces with respect to the stator end surfaces.

The single vane and double vane apparatus of the present invention embody two important distinctions from the prior art UniVane® patents (U.S. Pat. Nos. 5,374,172, 6,503,071, 6,623,261). First, roller bearings are used to control the radial position of the vane and second, axial positioning control rods or pins are used to dictate the axial position of the vane (its 'centralization') with respect to the rotor and the endplates. The prior art UniVane patents teach the use of a second set of ball bearings that simultaneously control both the radial and axial location of the vane and operate with respect to the stator endplates and not the rotor.

Unlike the prior art, the present invention teaches specific means to achieve the practical use of both a single vane and a dual vane device in which problems of dynamic balance and precision radial vane centering is achieved through the use of roller bearings; not ball bearings. The embodiments taught herein primarily encompass the application of precision rotor centering directly with respect to the stator housing, vane centering with respect to rotor (not the stator) and the dynamic balance design of the gliders required for practical single and dual vane devices.

SUMMARY OF THE INVENTION

A primary objective of the invention is to provide new methods, systems, apparatus and devices that provide a mechanically-governed, positive-displacement, non-contact sealing compression or vacuum device.

A second objective of the invention is to provide new methods, systems, apparatus and devices to provide a positive displacement rotary vane compressors and vacuum pumps that embrace the basic concept of friction reduction, and efficiency enhancement and exceedingly long operating life through the creation of specific means that result in non-contact gas sealing of the process gas.

A third objective of the invention is to provide new methods, systems, apparatus and devices that provide a mechanism whose moving parts exercise precision repetitive internal motion at a level of accuracy required to insure that the moving parts do not contact the static, non-moving parts of the machine and, simultaneously, maintain internal sealing clearance gaps small enough to keep internal leakage acceptably small in order to yield high efficiency.

A fourth objective of the invention is to provide new methods, systems, apparatus and devices to provide precision rotor centering directly with respect to the stator housing, vane centering with respect to rotor (not the stator) and the dynamic balance design of the gliders required for practical single and dual vane devices.

A fifth objective of the invention is to provide new methods, systems, apparatus and devices that uses roller bearings to control the radial position of the vane.

A sixth objective of the invention is to provide new methods, systems, apparatus and devices that uses axial positioning control rods or pins to control the axial position of the vane, its centralization, with respect to the rotor and the endplates.

A seventh objective of the present invention is to provide new methods, systems, apparatus and devices for a DuoVane machine wherein the second vane blocks the noise pulse inherent to the incomplete emptying of the volume at the discharge valve assembly in the MonoVane unit to provide both a quieter and considerably smaller machine.

An eighth objective of the present invention is to provide new methods, systems, apparatus and devices for a positive-displacement, non-contact sealing compression device for circulating hydrogen, ionized or deionized water and hydrogen or an alternative fuel.

A ninth objective of the present invention is to provide new methods, systems, apparatus and devices for a positive-displacement, non-contact sealing compression device for fuel cell applications for use with transportation devices, such as cars, trucks, busses and the like.

A tenth objective of the present invention is to provide new methods, systems, apparatus and devices for high efficiency, low-pressure, non-lubricated air compressors and hydrogen circulators.

An eleventh objective of the present invention is to provide new methods, systems, apparatus and devices to provide a compressor for use in life sciences, semiconductor processing, medical device, vacuum pump applications, and for pond aeration systems at golf courses.

A twelfth objective of the present invention is to provide new methods, systems, apparatus and devices to provide a compressor for use as a reversible refrigerant compressors, and miniature compressors and vacuum pumps.

A thirteenth objective of the present invention is to provide new methods, systems, apparatus and devices to provide a compressor or vacuum device that is lubricant-free.

A fourteenth objective of the present invention is to provide new methods, systems, apparatus and devices to provide compressor or vacuum devices that are non-contact and virtually frictionless.

The methods, systems, apparatus and devices of the present invention provide a positive displacement apparatus having a stator housing having an interior bore therethrough, a first and a second endplate connected to the stator housing at each end of the interior bore to form a compression or vacuum chamber. A rotor having a rotor shaft is positioned in the interior bore such that one end of the rotor shaft is connected to an external power source for rotating the rotor within the interior bore. A rotor centering device is used for centering the rotor with respect to the stator housing to prevent the rotating rotor from contacting the interior bore and the first and second endplates. A rotating vane assembly having at least one vane and a vane centering device for connecting the rotating vane assembly to the rotor shaft and centering at least one vane with respect to the rotor. The rotor centering device controls a radial position of the rotating vane assembly and the vane centering device controls an axial position of rotating vane assembly to prevent contact of the at least one vane with the stationary compression chamber components.

In an embodiment, rotating vane assembly includes one vane. In another embodiment, the vane assembly includes a first and a second vane positioned approximately 180° apart, such that as the first vane and the second vane rotate the second vane blocks a noise pulse inherent to the incomplete emptying of the volume at the discharge valve assembly to provide a quieter compression apparatus.

Summarily, the embodiments taught in the present invention described herein primarily encompass the application of precision rotor centering directly with respect to the stator housing, vane centering with respect to rotor (not the stator) and the dynamic balance design of the gliders required for practical single and dual vane devices.

Further objects and advantages of this invention will be apparent from the following detailed description of preferred embodiments which are illustrated schematically in the accompanying drawings.

DESCRIPTION OF THE PREFERRED EMBODIMENTS

Figure 1A:
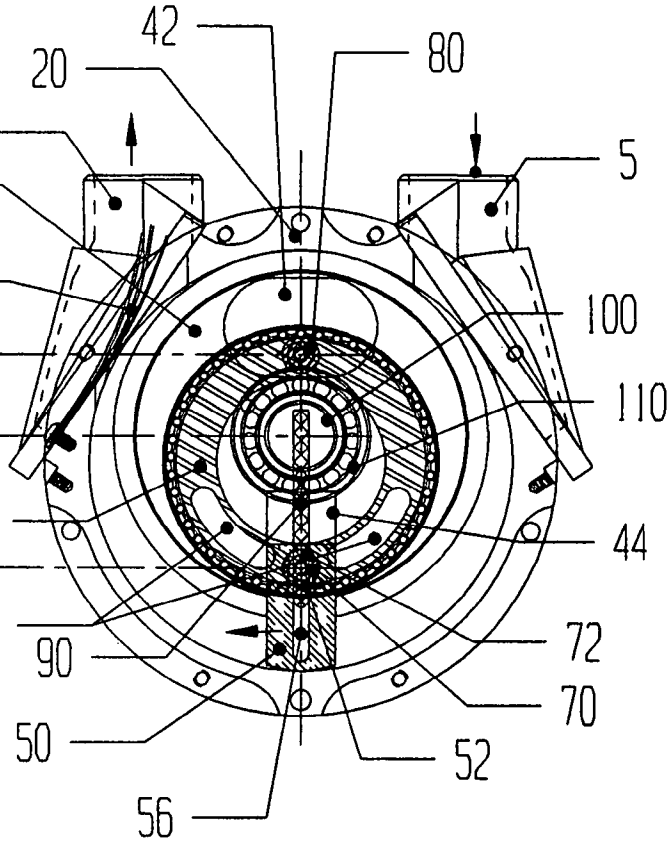
FIGS. 1*a* and 1*b* are a front view and a side view, respectively, of an orbital MonoVane device according to the present invention.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The following is a list of the reference numbers used in the drawings and the detailed specification to identify components:

| | |
|---|---|
| 5 | inlet manifold |
| 10 | left endplate |
| 15 | discharge manifold |
| 20 | stator |
| 30 | right endplate |
| 40 | rotor |
| 42 | void region |
| 44 | rotor slot |
| 50 | vane |
| 52 | axle through-hole |
| 54 | vane slot |
| 56 | vane hole |
| 56a | vane hole |
| 57 | vane hole |
| 60 | roller bearing |
| 62 | glider races |
| 64 | counterbalance voids |
| 70 | vane axle |
| 72 | cross-hole |
| 82 | vane ring spacer |
| 80 | glider race post |
| 90 | control rod |
| 91 | control rod |
| 100 | rotor shaft |
| 103 | hole |
| 104 | shaft hole |
| 110 | ball bearing |
| 140 | rotor |
| 144 | first rotor slot |
| 145 | second rotor slot |
| 150 | first vane |
| 151 | second vane |
| 152 | axle through hole |
| 153 | axle through hole |
| 156 | vane hole |
| 157 | vane hole |
| 161 | roller bearings |
| 162 | first glider race |
| 163 | second glider race |
| 170 | discharge valve assembly |
| 180 | vane axle |
| 181 | vane axle |
| 190 | control rod |
| 191 | centering rod |
| 240 | rotor |
| 250 | vane |
| 251 | vane |
| 257 | centering rod |
| 261 | bearings |
| 262 | glider racers |
| 263 | glider racers |
| 265 | bearing mount |
| 270 | vane axle stub |
| 270a | snap ring |
| 271 | vane axle stub |
| 271a | snap ring |
| 275 | vane axle pass-through void |
| 276 | hot dog-shaped voids |
| 277 | voids |
| 280 | vane bearing rings |

-continued

| | |
|---|---|
| 282 | balance voids |
| 285 | vane |
| 286 | endplate |
| 286a | extension |
| 287 | cross slots |
| 290 | axle stubs |

The methods, systems, apparatus and devices of the present invention provide very exact mechanical devices that rigidly holds rotating compressor parts in precision cyclic paths of continuous motion that do not engage or touch the non-rotating components. The non-engagement distance, the leakage clearance is small enough to insure that the gas being processed by the compressor has only minimal leakage during inlet, compression and discharge. In the preferred embodiment of the present invention, the rotating rotor and its accompanying vane or vanes are positioned securely within their non-rotating stator such that they do not rub against the inner surfaces of this stationary cavity which includes both opposing endplates and the interior bore of the stator housing.

The present invention provides two new non-contact sealing compressors and variations thereof herein after called MonoVane for the single-vane version and DuoVane for the dual-vane version. Certain embodiments are less expensive to manufacture and operate at much higher pressures, including refrigerant compressor pressures with the use of a lubricant.

Both the MonoVane and DuoVane embodiments use roller bearings to control the radial position of the vane and use control rods or pins to control axial positioning of the vane, its 'centralization' with respect to the rotor and the endplates. The prior art devices used a second set of ball bearings to simultaneously control both the radial and axial location of the vane and operated with respect to the stator endplates and not the rotor.

This centering of the rotating part is achieved because ball bearings hold both radial and axial positioning. On the other hand, roller bearings, while capable of withstanding very significant loads and are generally much less expensive than ball bearings, only position radially, they have no significant capability of constraining items in the axial direction.

In compressing and vacuum devices it is very important to insure that the vane, as well as the rotor, does not rub against either of the stator endplates. The present invention provides mechanisms and structures that accommodate the requirement of precise radial vane positioning with the use of roller bearings that do not provide axial position control.

A method for determining the structural requirements to provide apparatus and devices according to the present invention includes the following steps. First, the rotor is accurately located with respect to the stator. Having the rotor location determined, the vane is precisely located with respect to the rotor, and not the stator. The accurate axial vane location with respect to the rotor, and therefore the stator, is achieved using control rods that are firmly and accurately installed within the vane slot and rotor shaft to engage a precision hole in the vane to hold the vane in the desired axial position.

There is no essential difference in the action of the DuoVane machine and the MonoVane except that by using two vanes the displacement is essentially doubled and the second vane blocks the noise pulse inherent to the incomplete emptying of the volume at the discharge valve assembly in a single-vane unit. Thus, the additional complication involved in the DuoVane does offer both a quieter and considerably smaller machine.

Both the MonoVane and the DuoVane operate in essentially the same manner. Specifically, when the rotor shaft 100 is rotated from an external mechanical/electrical power source, air is induced into the compressor through the inlet manifold 5, is compressed in the volume of the compression chamber created by the outer diameter of the rotor 40, the internal bore of stator housing 20, the vane 50 and the sealing and confinement actions of endplates 10 and 30.

When the compression pressure slightly exceeds the pressure within the discharge manifold 15, the discharge valve assembly opens and permits the pressurized fluid to pass through the compressor and flow through the outlet manifold 15 and flows to its particular objective as dictated by a given application or use. Thus, the compressor simply pulls the gas (often, air) into itself, compresses the gas and expels it.

The MonoVane and DuoVane devices are non-contact and virtually frictionless machines that can be applied to many application and the operating parameters may be adjusted to meet the needs of the particular application. For example, according to the present invention the MonoVane and DuoVane devices may be configured for alternative flow rates, inlet pressures, boost pressures and gas density based on the application in which the device is used. More specifically, the device may be configured for a flow rate that is within a range of approximately 20 LPM up to approximately 5000 LPM. Correspondingly, the devices may be configured for an inlet pressure within a range of approximately 0 to approximately 35,000 kPa and a boost pressure of approximately 0 to approximately 250 kPa.

One example of an application is for fuel cell applications for use with transportation devices, such as cars, trucks, busses and the like. The devices can be used for circulating hydrogen, ionized or deionized water and hydrogen or an alternative fuel. Other uses include high efficiency, low-pressure, non-lubricated air compressors and hydrogen circulators, compressor for use in life sciences, semiconductor processing, medical device, vacuum pump applications, for pond aeration systems at golf courses, reversible refrigerant compressors, and miniature compressors and vacuum pumps. While a variety of application has been provided, those skilled in the art will appreciate that the devices of the present invention may be used for alternative applications.

First Embodiment—MonoVane

Figure 1B:
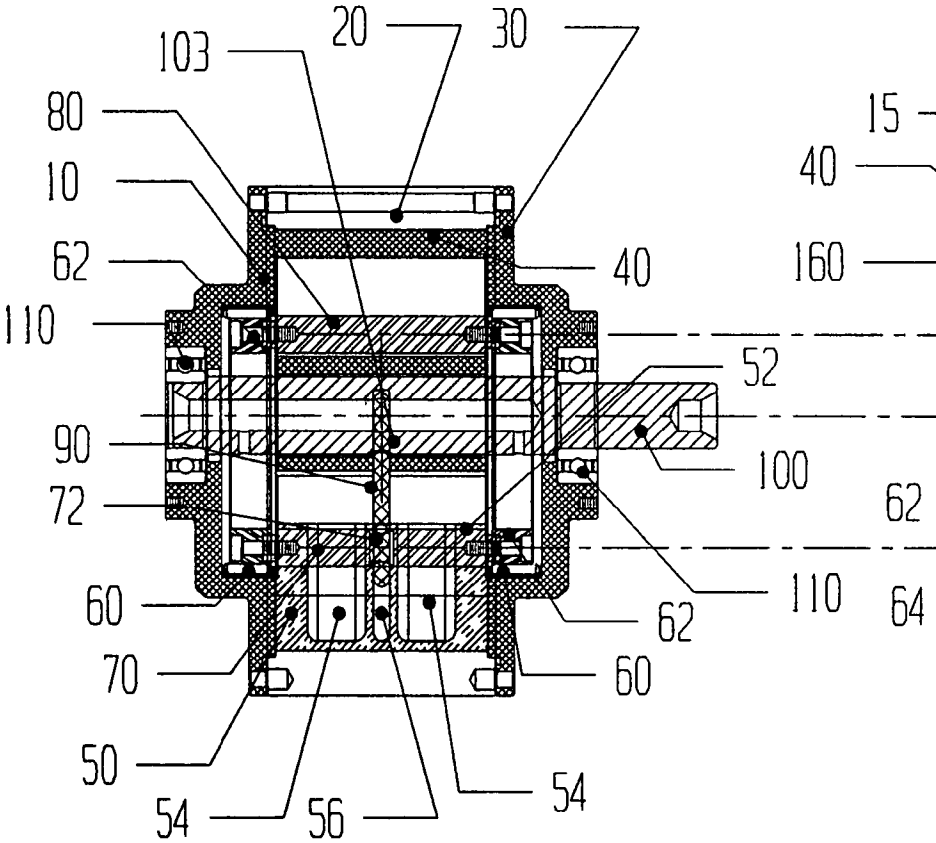
Figures 2A, 2B:
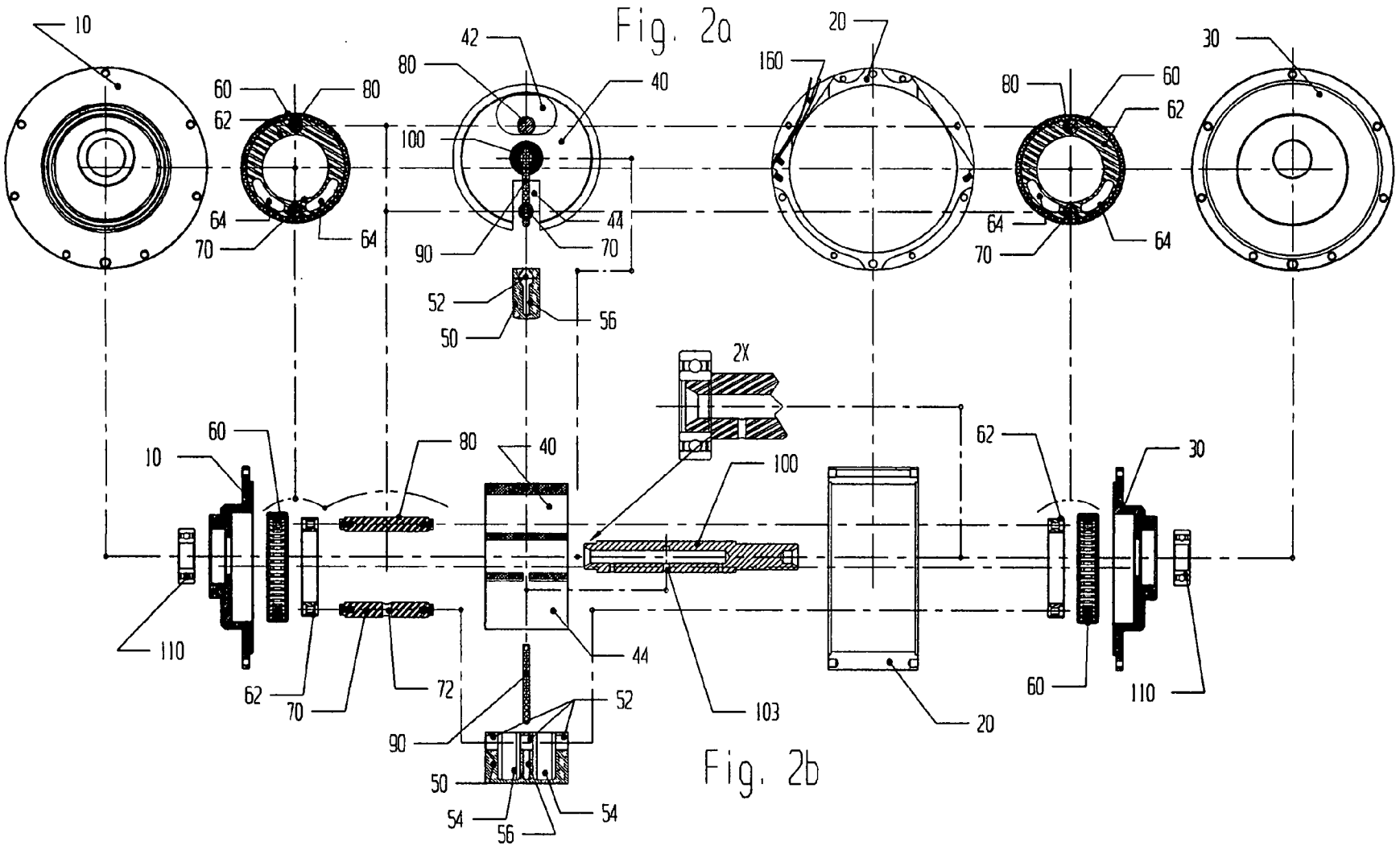
FIGS. 2*a* and 2*b* shows a disassembled front view and side view, respectively, of the orbital MonoVane device shown in FIGS. 1*a* and 1*b*, respectively.

FIGS. 1*a* and 1*b* are a front view and a side view, respectively, of the Orbital MonoVane mechanism of the present invention. As shown, the MonoVane device uses a combination of roller bearings to govern the radial vane tip position and an axial positioning element embedded in the rotor and rotor shaft and operating in concert with a mating precision radial hole in the vane to use the rotor for centering the vane. The ball bearings also centralize the rotor location within the stator. FIGS. 2*a* and 2*b* show the separated layout of the assembly shown in FIGS. 1*a* and 1*b* and, therefore, further illustrates the details of this invention embodiment.

Figures 3A, 3B:
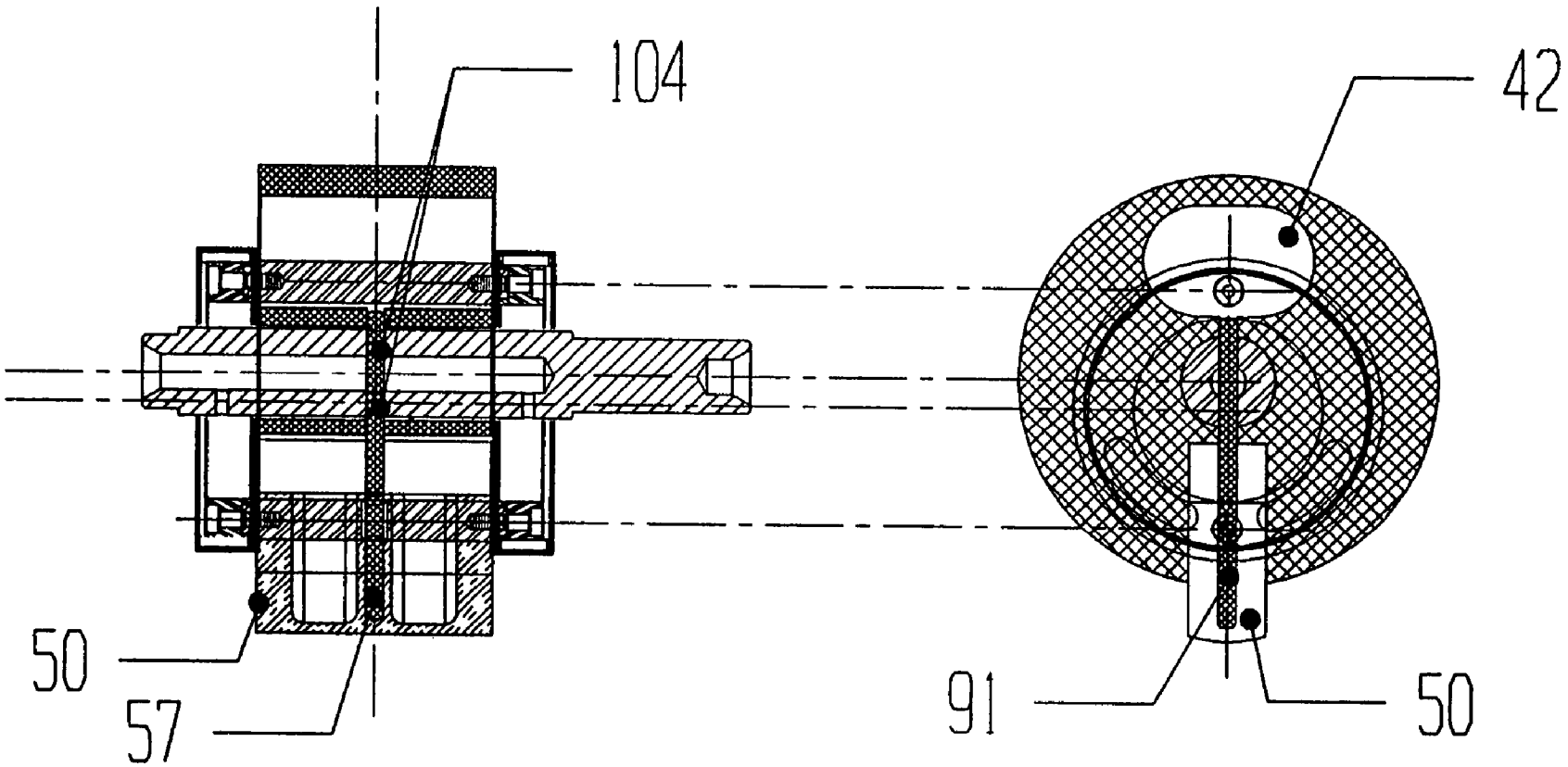
FIGS. 3*a* and 3*b* are a side view and corresponding front view, respectively, showing the use of roller bearings to control the radial location of the vane with respect to a rotor centered with respect to the stator and the use of a centering control rod to control the vane's axial location.

Referring to FIGS. 3*a* and 3*b* in conjunction with FIGS. 1*a*, 1*b* and FIGS. 2*a* and 2*b*, the device consists principally of left endplate 10, stator 20, right endplate 30, rotor 40, and vane 50. In the configurations shown, rotor shaft 100 is firmly attached to the rotor body 40 by any means known to the art. Rotor rotation occurs when sufficient power is applied to the rotor shaft 100, which is held and positioned by bearings 110. As a direct result, the vane 50, contained within the rotor slot 44, is propelled in circular motion by the rotor 40 within the stator 20 cavity. The rotor 40 can be confined to its radial and axial position by, in addition to ball bearings 110, a variety of other conventional bearings such as tapered roller bearings, combinations of roller bearings for the radial location of the rotor shaft 100 and roller thrust bearings for the rotor's axial location with respect to the stator 20, as well as roller bearing/ball thrust bearing combinations.

In order to enable the machine to become nearly frictionless, however, in addition to insuring that the rotor 40 does not touch either left endplate 10 or right endplate 30 or the stator 20 through rotor centering, other subcomponents are required to insure that the vane 50 does not rub against the stationary parts (i.e.: the stator bore and the inner surfaces of the endplates). Vane axle 70 engages the axle through-hole 52 in vane 50. The ends of these axles are fastened in usual ways to the inner glider races 62 that operate within the roller bearings 60 (drawn-cup caged type shown here) installed within left and right endplates 10 and 30, respectively. The circular outer diameter of glider races 62 can be slightly crowned to accommodate slight misalignments of the bearings 60 and glider races 62. The rollers of roller bearings 60 can also be crowned to accommodate the same conditions.

Vane ring spacer 82 provides additional mass to help counter-balance the mass of the vane 50 and vane axle 70. Counterbalance voids 64 are shaped holes placed in glider races 62 and are sized such that they insure that the rotating vane assembly is dynamically balanced about its center of rotation. Other means known to the art of dynamic balancing can be applied to balance the rotating vane subassembly. This subassembly, again consisting of the vane 50, vane axle 70 both glider races 62 and the spacer 82, controls the precise radial location of the vane tip, whose radius is coincident with the center of the vane axle 70.

While roller bearings can take high loads, they lack the ability to control axial vane drift, a back-and-forth motion that would cause wear and friction of the vane sides against the endplates. The present invention overcomes that problem through the use of a centralizing or positioning control rod 90 that is firmly attached to rotor shaft 100 as shown in FIGS. 1 and 2, inserted into a hole 103 that is placed in the rotor shaft 100 in the middle of the rotor slot 44 of rotor 40.

In the preferred embodiment, this control rod 90 precisely engages vane hole 56 of vane 50 and prevents axial, side-to-side motion of the vane 50 in rotor slot 44 of rotor 40. Vane axle 70 is fitted with cross-hole 72 that is large enough to accommodate both the diameter and shape of the control rod 90 and approximately +/− 15° relative angular motion between the vane 50, control rod 90 and its respective vane axle 70. While a single control rod 90 is shown, numerous other means can be substituted, such as multiple-rods or conjugate surfaces between the rotor 40 and the vane 50 that will serve to axially anchor the vane to the rotor 40.

Figure 3C:
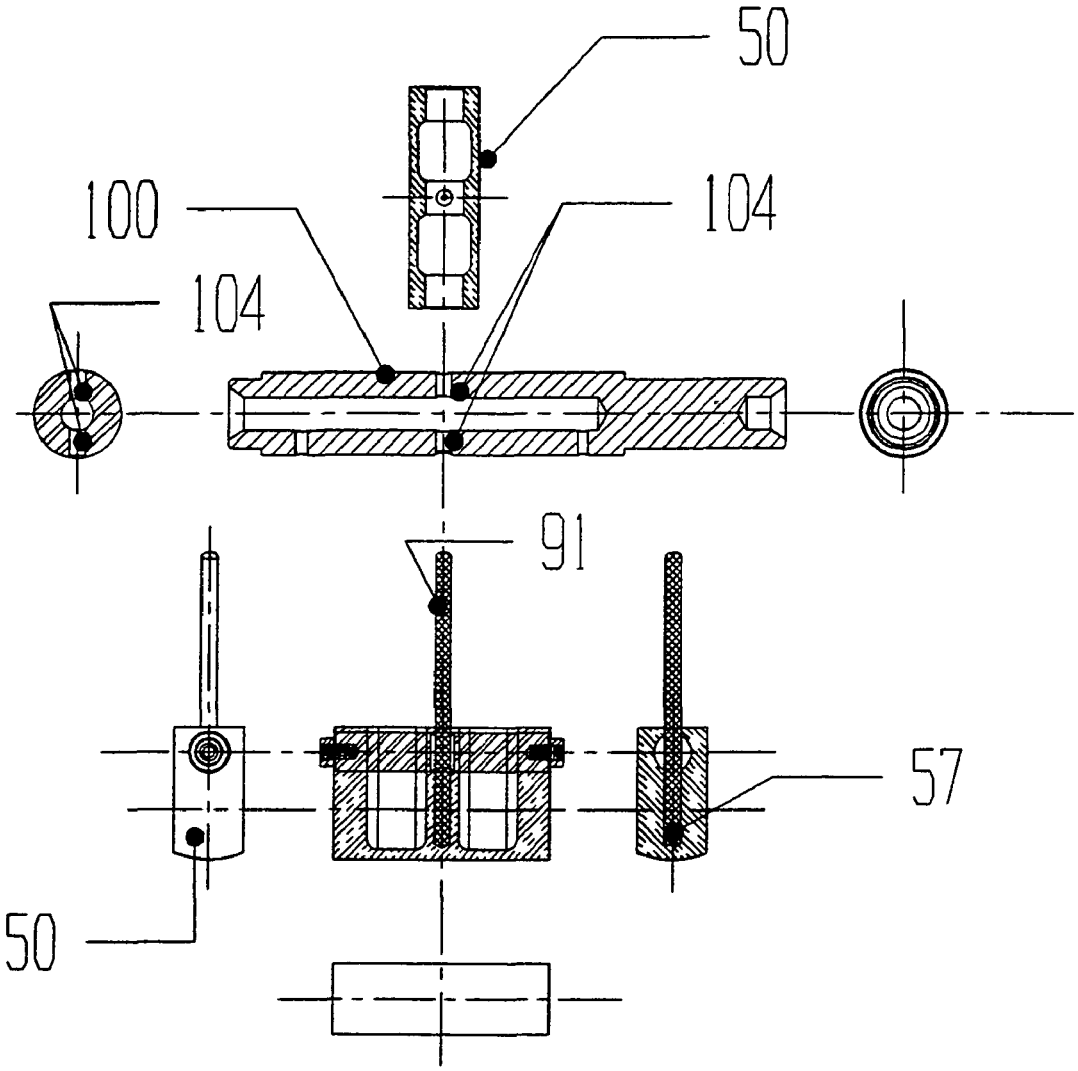
FIG. 3*c* is an expanded view showing the use of roller bearings to control the radial location of the vane with respect to a rotor centered with respect to the stator and the use of a centering control rod to control the vane's axial location in separated views.

FIGS. 3*a* and 3*b* shows a side view and a front view, respectively, of the MonoVane device and FIG. 3*c* is a disassembled side view of the device shown in FIGS. 3*a* and 3*b*. FIGS. 3*a*, 3*b* and 3*c* show the use of roller bearings 60 to control the radial location of the vane 50 with respect to the rotor 40 which is centered with respect to the stator 20 and shows the use of a centering control rod 90 to control the vane's 50 axial location. The rotor 40 is fixed with respect to the stator housing 20 as previously described. However, the centering control rod 91 is fixed in the vane 50 and reciprocates within a precision radial hole 104 within the rotor slot 44 bottom and the rotor shaft 100.

As shown in FIGS. 3*a* and 3*b*, the inverse variant of the control rod method is show wherein an alternative control rod 91 is fixed to the vane 50 within vane hole 57 and reciprocates within shaft hole 104 that passes through the bottom of the vane slot 54, through the rotor shaft 100 and into the void region 42. This void 42 is shaped so it can both dynamically balance the rotor 40 to make up for the void 42 comprising the vane slot 44 (FIG. 2) and to accommodate the relative motion of the glider race post 80 and vane axle 70 (FIG. 1).

Figures 4A, 4B, 4C:
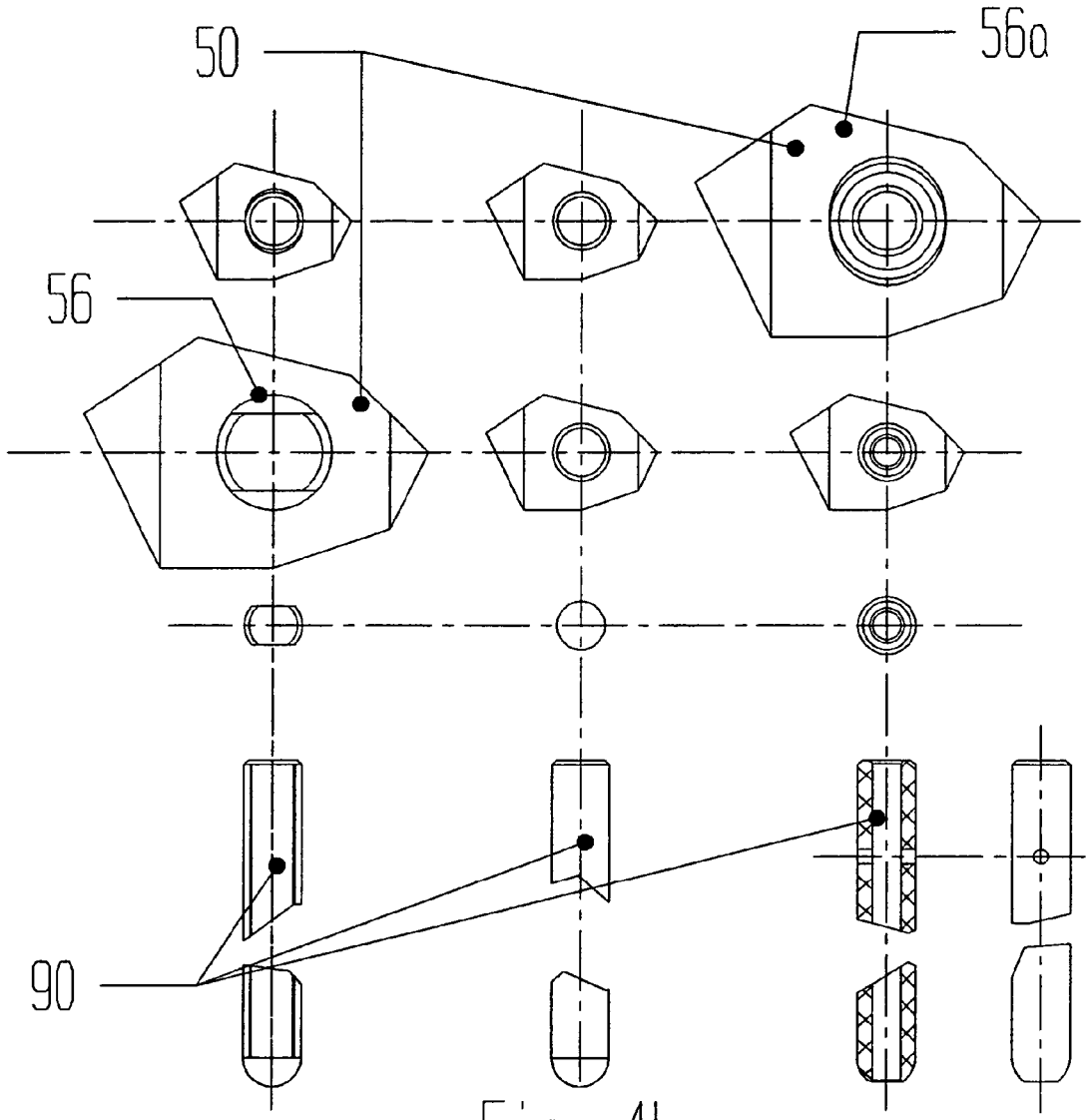
FIGS. 4*a*, 4*b* and 4*c* show alternative examples of the vane-centralizing positional control rod and the mating passage accommodating the control rod.

FIGS. 4*a* and 4*b* shows alternative embodiments of the vane-centralizing positional control rod and the mating passage accommodating the control rod 90 and alternatively, control rod 90. In the example shown in FIG. 4*a*, the control rod 90 has flattened sides wherein the flat sides reduce the positioning accuracy requirement of the location of control rod 90 and disallow inadvertent pressure build-up within the vane hole 56. This example relieves undesired forces that may arise as slight tolerance stack-ups occur between the vane hole 56, the vane 40 and the vane slot 44.

FIG. 4*b* shows a round control rod 90 used with a round hole 56 in the vane 50. FIG. 4*c* shows that a round control rod 90 could be used within a hole 56*a* that is 'race track' in shape and orthogonal to the vane slot 54 to avoid stack-up of tolerances that could lead to contact friction between the control rod 92 and the hole 56*a* and the vane 50 within the vane slot 54. Recall that there is virtually no axial forces for the control rod 90 to control due to the nearly exact axial symmetry of the compressor and, therefore, the side-to-side fluid forces acting on the vane 50 are very approximately zero, but are strong enough to cause an axial drift and contact with the endplates, resulting in friction and wear if they are not positively held in the correct central axial location. Control rod 90 or alternative control rod 99, can be hollow (FIG. 4*c*) and be fitted with cross-holes which can be used both to relieve pressure build-up at the tips of control rods 90 (FIG. 4*b*) and 91 (FIG. 4*a*) and to distribute lubricant when used with lubricated machines.

As previously described, FIGS. 1 and 2 show the rotor shaft 100 held in place using ball bearings 110. In the preferred embodiment, rotor centralization requires that several dimensional conditions be met. In addition to insuring that parts are produced with acceptable precision regarding rotor concentricity, outside diameter and orthogonality of the opposing rotor faces with respect to the bearing surfaces of the rotor shaft. It is important that acceptable tolerances be reached. Further, there is the need for adequate assembled parallelism of the inner surfaces of the endplates, alignment of the rotor bearing bores and a sufficient decrimental difference between the rotor and vane length and the inner span between the endplates, ie: the physical clearance.

After satisfying the manufacturing accuracy requirements, the challenge becomes the specific axial location of the bearings such that their position insures centrality of the rotor. This requirement is achieved in a variety of ways, the most obvious of which involves particularly tight manufacturing tolerances so that the rotor will be in the proper place immediately upon assembly. Less accurate machining would add a requirement for the measurement and placement of selective spacers or alternative compensation components. Regardless of the manufacturing method, in the preferred embodiment, the proper placements of the bearings, and, consequentially, the rotor is a primary key to non-contact sealing in the devices of the present invention.

Second Embodiment—DuoVane Device

The DuoVane machine is a two-vane version of the MonoVane machine described above. Briefly, it contains a second similar, but not identical, set of subcomponents that enable it to carry the second vane in essentially the same way as the MonoVane machine carries the single vane. An example of a DuoVane machine shown in FIGS. 5 and 6 consists principally of left endplate 10, stator 20, right endplate 30, rotor 140, and vanes 150 and 151. In the configurations shown, rotor shaft 100 is firmly attached to the rotor body 140 by any means known to the art. Rotor rotation occurs when sufficient power is applied to the rotor shaft 100, which is held and positioned by bearings 161. As a direct result, the vanes 150 and 151, contained within the rotor slots 144 and 145, respectively, are propelled in circular motion by the rotor 140 within the stator 20 cavity.

Referring to FIGS. 5*a* and 5*b* and FIGS. 6*a* and 6*b*, as previously described in regard to the MonoVane device, other subcomponents are required to insure that the vanes 150 and 151 do not rub against the stationary parts (i.e.: the stator bore and the inner surfaces of the endplates). Vane axles 180 and 181 engage the axle through-hole 152 and 153 in vanes 150 and 151, respectively. The ends of these axles are fastened in usual ways to the inner glider races 162 and 163 that operate within the roller bearings 161 (drawn-cup caged type shown here) installed within left and right endplates 10 and 30, respectively. The circular outer diameter of glider races can be slightly crowned to accommodate slight misalignments of the bearings 161 and glider races 162 and 163. The rollers of roller bearings 161 can also be crowned to accommodate the same conditions. In the preferred embodiment, this control rod 190 precisely engage vane holes 156 and 157 of vanes 150 and 151, respectively, and prevents axial, side-to-side motion of the vanes 150 and 151 in rotor slots 144 and 145, respectively, of rotor 140.

Figures 5A, 5B:
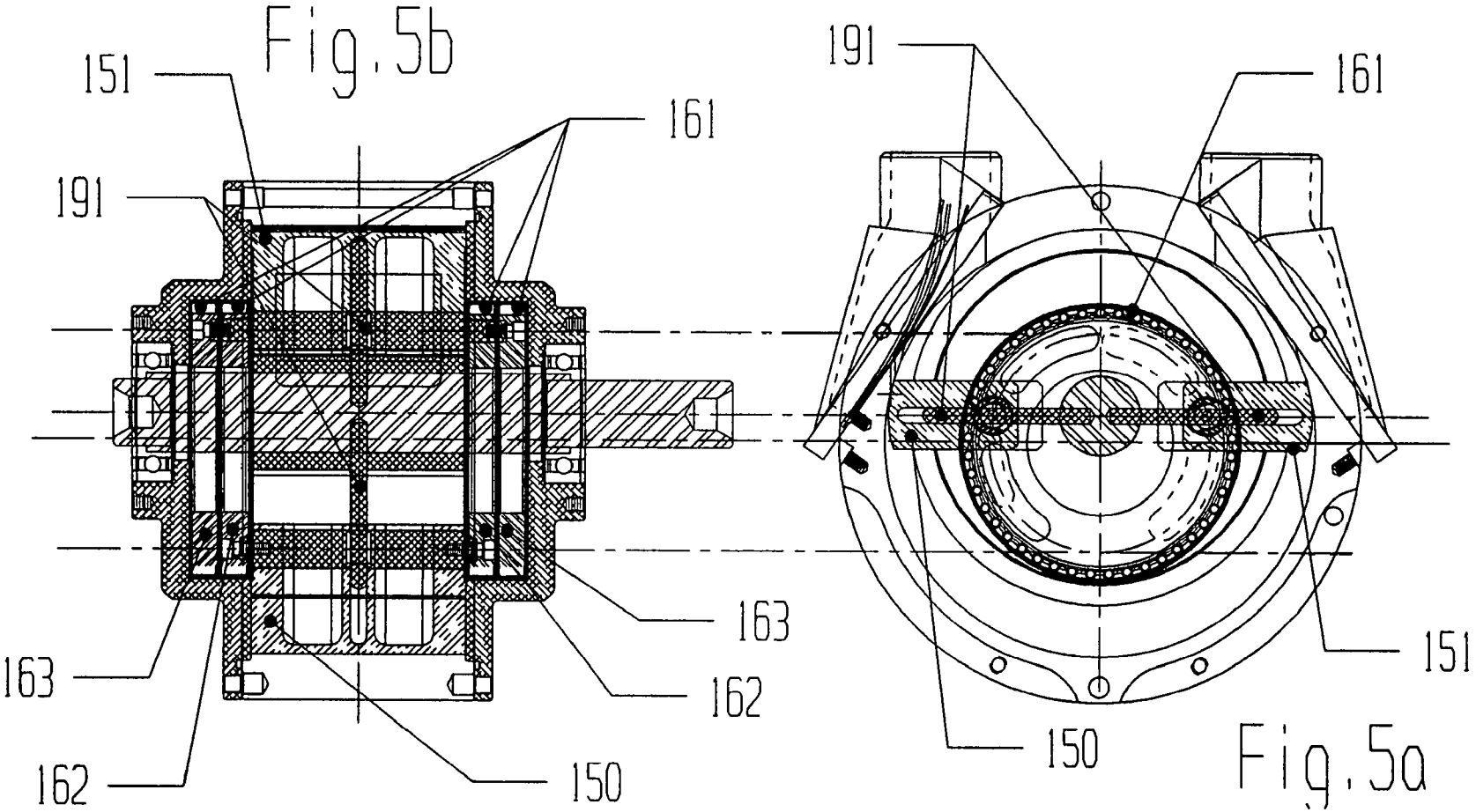
FIG. 5*a* shows front view of the DuoVane embodiments of the present invention wherein the roller bearings are placed on the OD of the glider rings.
FIG. 5*b* shows a side view of the DuoVane embodiment shown in FIG. 5*a*.

As shown in FIG. 5*a*, addition of the second vane 151 allows nearly twice the displacement of a machine using a single vane, regardless of the type. Further, with the inclusion of a second vane 151, there is always a vane closing at the inlet port 5 slightly before the discharge port is reached by the leading vane 150. This is a very important feature from the standpoint of noise containment because as the leading vane 150 passes the discharge port 15, there is a small volume of high pressure gas that produces a noise pulse of un-expelled gas that travels back around to the outlet port. With one vane 50, the noise is able to flow out the inlet port 5 and be clearly heard. In the two vane machine, the second vane 151 closes the inlet port 5 before the leading vane 150 reaches the outlet port 15. The second vane 151 blocks the inherent noise pulse from reaching the environment and recovers the small previously not-discharged mass. This results in a much quieter and slightly more volumetric-efficient compressor.

FIGS. 5 through 9 show alternative embodiments of the DuoVane machine. For example, FIGS. 5 and 6 show the use of a two-piece centering rod 191 with glider races 162 and 163 that run inside the roller bearings 161. Although a single control is shown, because of dimensional tolerances arising between the opposing vane slots during manufacture, independent control rods 191 that can accommodate positional variations may be used for each vane 150 and 151.

Figures 6A, 6B:
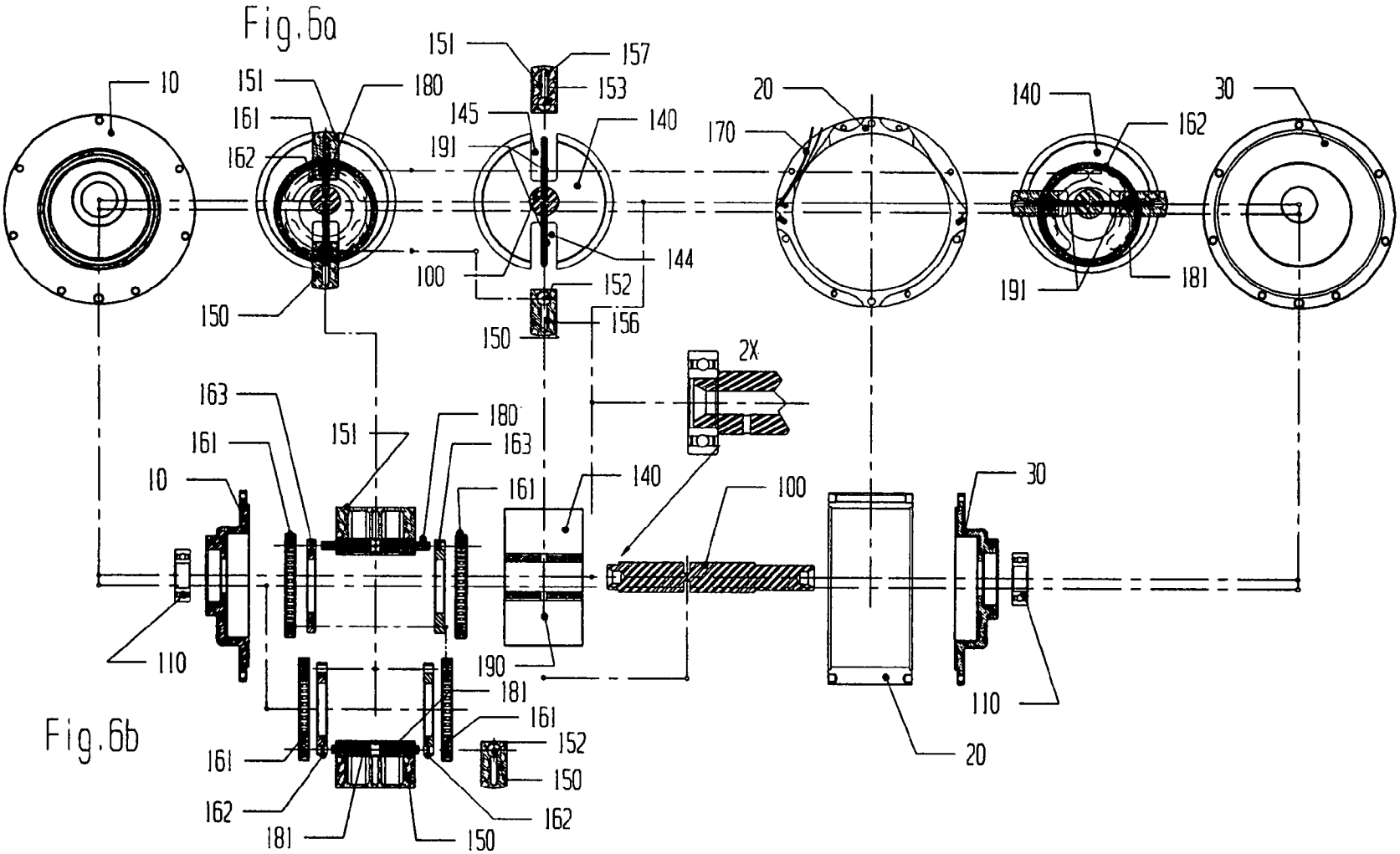
FIGS. 6*a* and 6*b* show expanded front and side views, respectively, of the DuoVane apparatus shown in FIGS. 5*a* and 5*b*, respectively, showing additional detail.

FIGS. 5*a* and 5*b* show a front and side view, respectively, of the DuoVane (double-vane) embodiments wherein the roller bearings 161 are placed on the outside diameter of the glider rings 162 and 163. FIGS. 6*a* and 6*b* show an unassembled view of the machine shown in FIGS. 5*a* and 5*b*, respectively, showing additional detail. The DuoVane machines shown in FIGS. 5 and 6 use roller bearings 161 such that the outside circumference of the glider rings 162 and 163 ride within bearings 261 that are installed in the bearing housings of endplates 10 and 30.

Figure 7A:
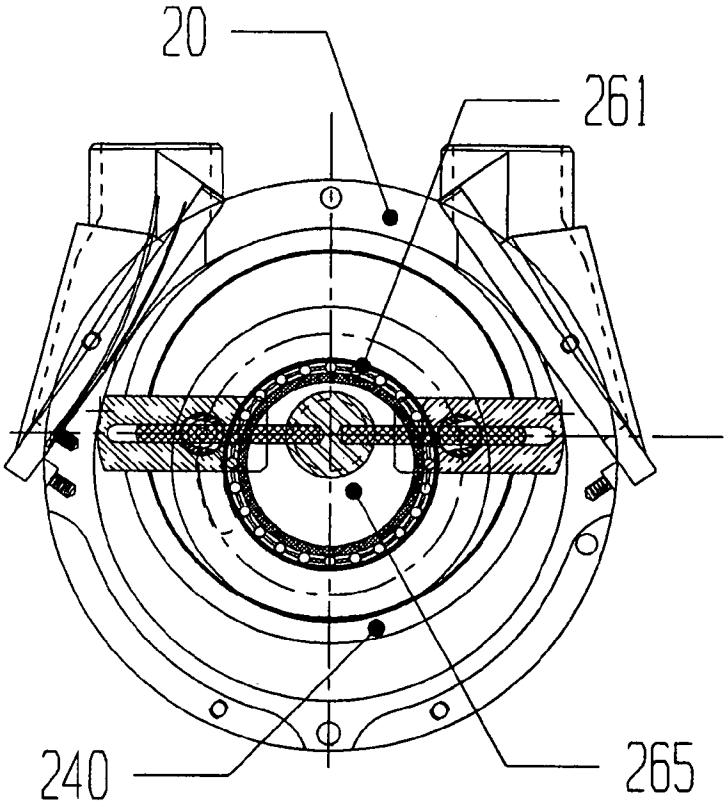
FIG. 7*a* is a front view showing another example of the DuoVane apparatus.
Figure 7B:
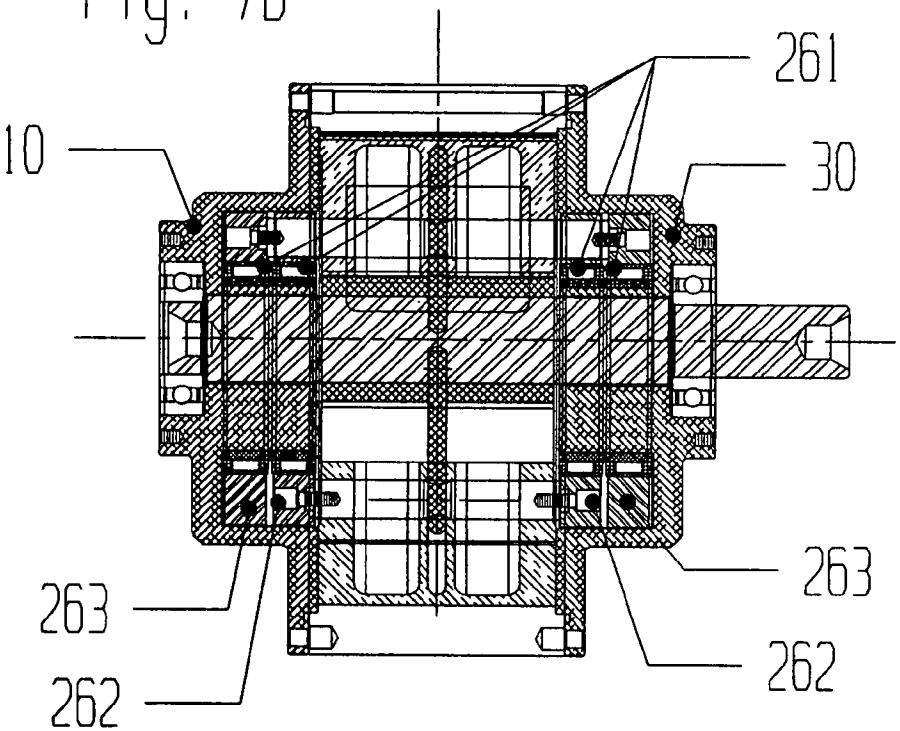
FIG. 7*b* is a side view of the DuoVane machine shown in FIG. 7*a*.
Figures 8A, 8B, 8C, 8D, 8E:
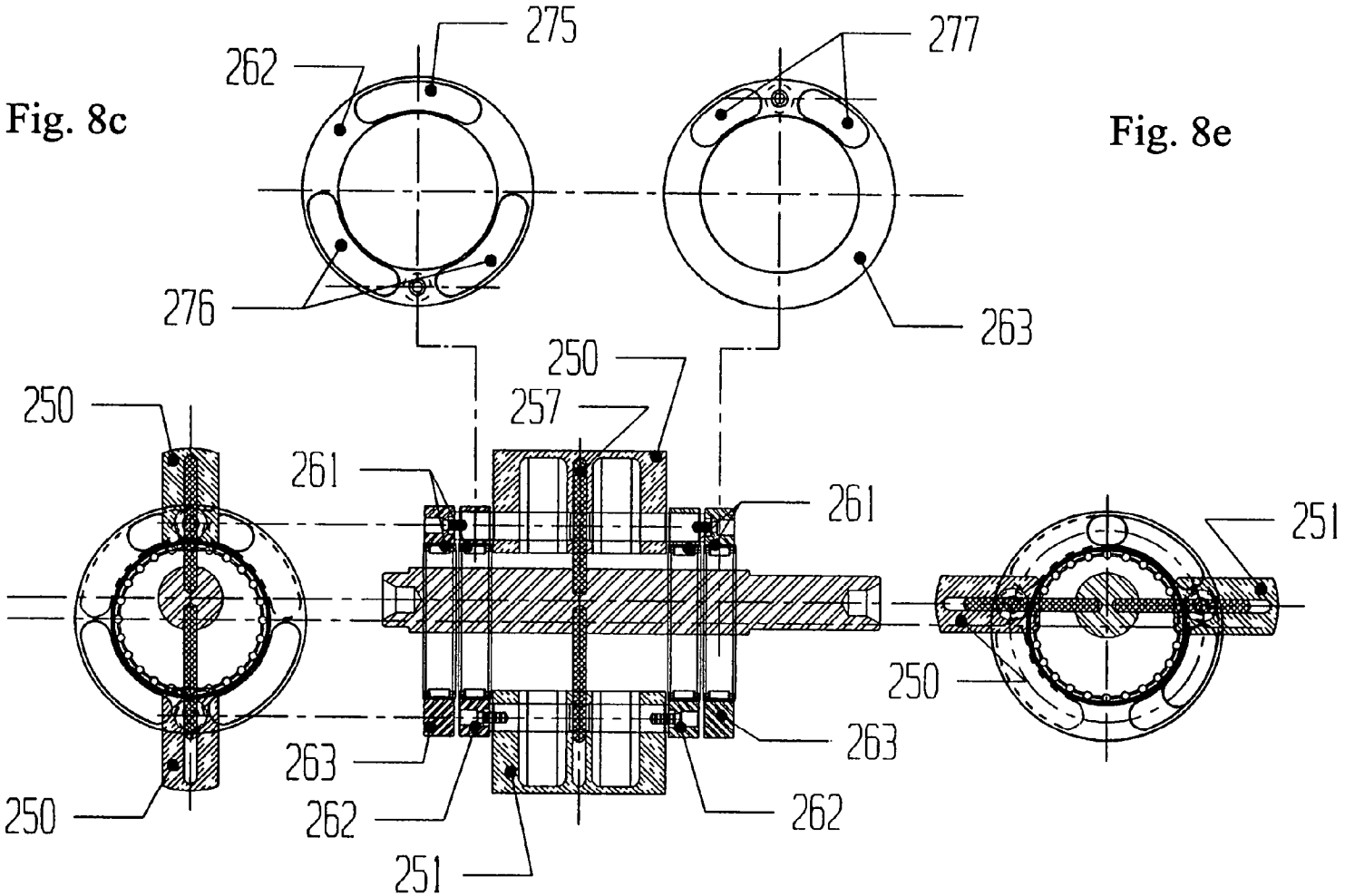
FIG. 8*a* is a front view showing additional detail of the rotating components of the DuoVane assembly shown in FIG. 7*b*.
FIGS. 8*b* and 8*c* show a front view of the rotating vane assembly and the vane counter balance, respectively, from one side.
FIGS. 8*d* and 8*e* show a front view of the rotating vane assembly and the vane counter balance, respectively, from an opposite side.

FIG. 7 shows a similar embodiment to the embodiment shown in FIGS. 5*a*, 5*b*, 6*a* and 6*c*. In this embodiment, glider rings 262 and 263 ride on the outside of the roller bearings 261. As shown, the roller bearings 261 are located on a bearing mount 265 that is concentric with the inside diameter of the stator bore of stator housing 20. FIGS. 8*a-e* shows additional detail of the assembly shown in FIG. 7, without showing the non-rotating components. FIG. 8*a* shows a front view of the rotating components of the DuoVane assembly shown in FIG. 7*b*; FIGS. 8*b* and 8*c* show a front view of the rotating vane assembly and the vane counter balance, respectively, from one side and FIGS. 8*d* and 8*e* show a front view of the rotating vane assembly and the vane counter balance, respectively, from an opposite side. In the preferred embodiment, this centering control rod 257 precisely engages vane holes of vanes 250 and 251 and prevents axial, side-to-side motion of the vanes 250 and 251 in rotor slots of rotor 240.

Figure 9:
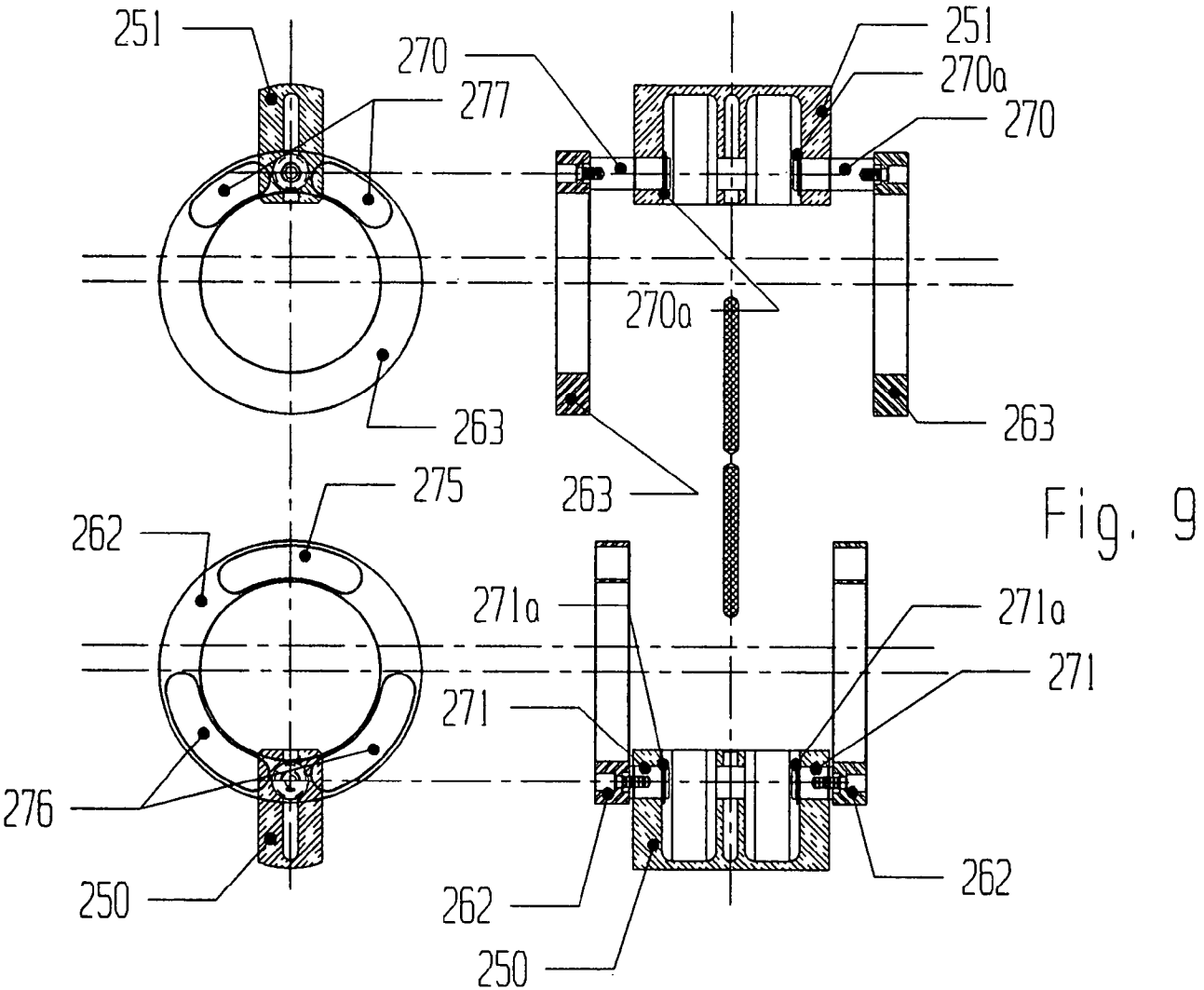
FIG. 9 shows another example of the DuoVane apparatus embodiment shown in FIG. 8.

FIG. 9 shows yet another embodiment quite similar to other DuoVane embodiments described above. The difference with the embodiment shown in FIG. 9 is that instead of having vane axles extend across the entire vane 250 and 251, vane axle stubs 270 and 271 are used and, as shown, are held in place by snap rings 270*a* and 271*a*, respectively, or any other fastening means known to the art can be used to achieve the attachment or, in some designs a fastener is not required. Use of vane axle stubs relieves the need for cross-hole 72 in vane axle 70 (FIG. 1) and also slightly eases the balancing of the rotating mechanism.

Figures 10A, 10B, 10C, 10D, 10E:
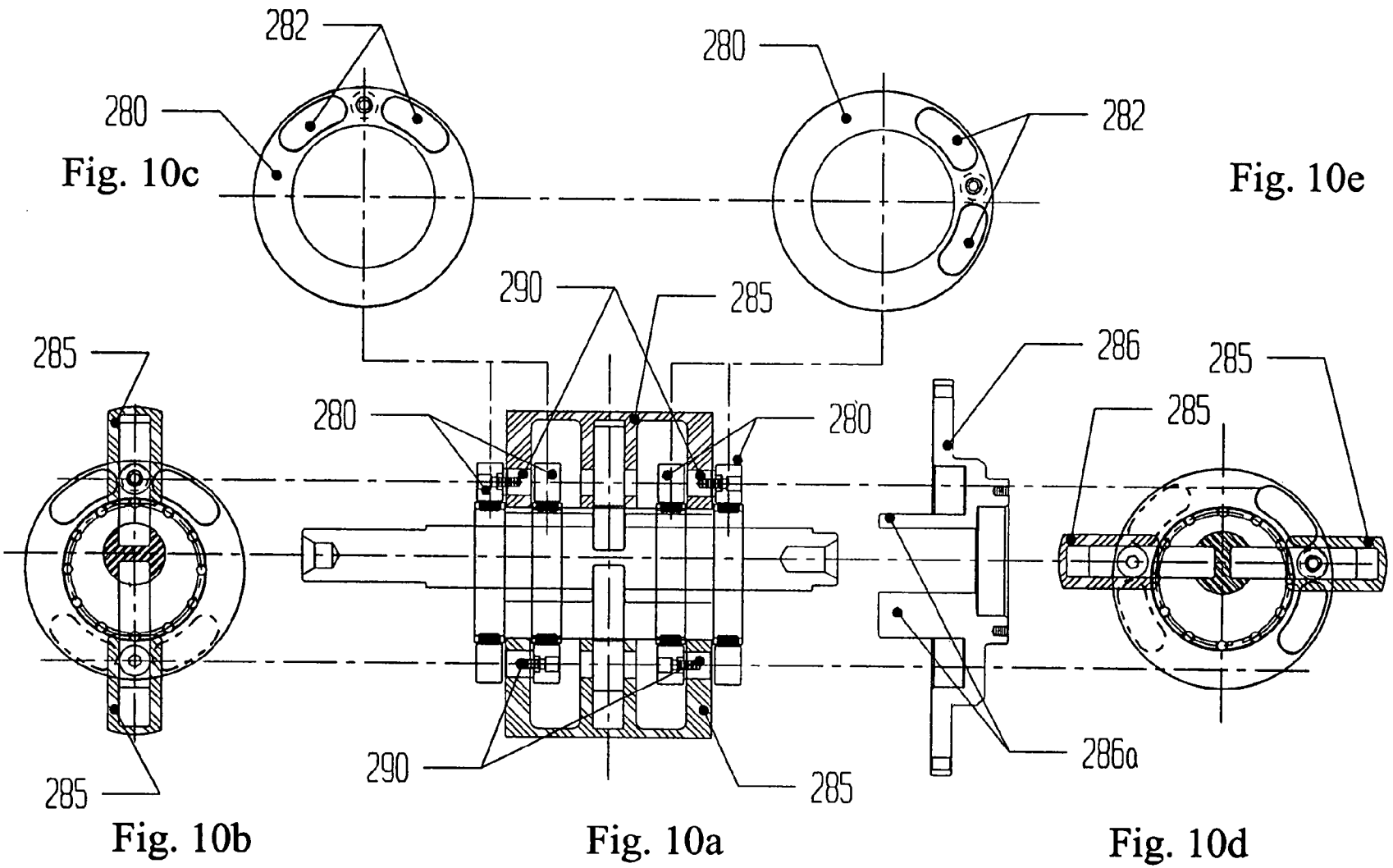
FIG. 10*a* shows yet another example of the DuoVane apparatus embodiment shown in FIG. 5*a* through FIG. 9.
FIGS. 10*b* and 10*c* show a front view of the rotating vane assembly and the vane counter balance, respectively, shown in FIG. 10*a* from one side.
FIGS. 10*d* and 10*e* show a front view of the rotating vane assembly and the vane counter balance, respectively, shown in FIG. 10*a* from an opposite side.
Figure 11:
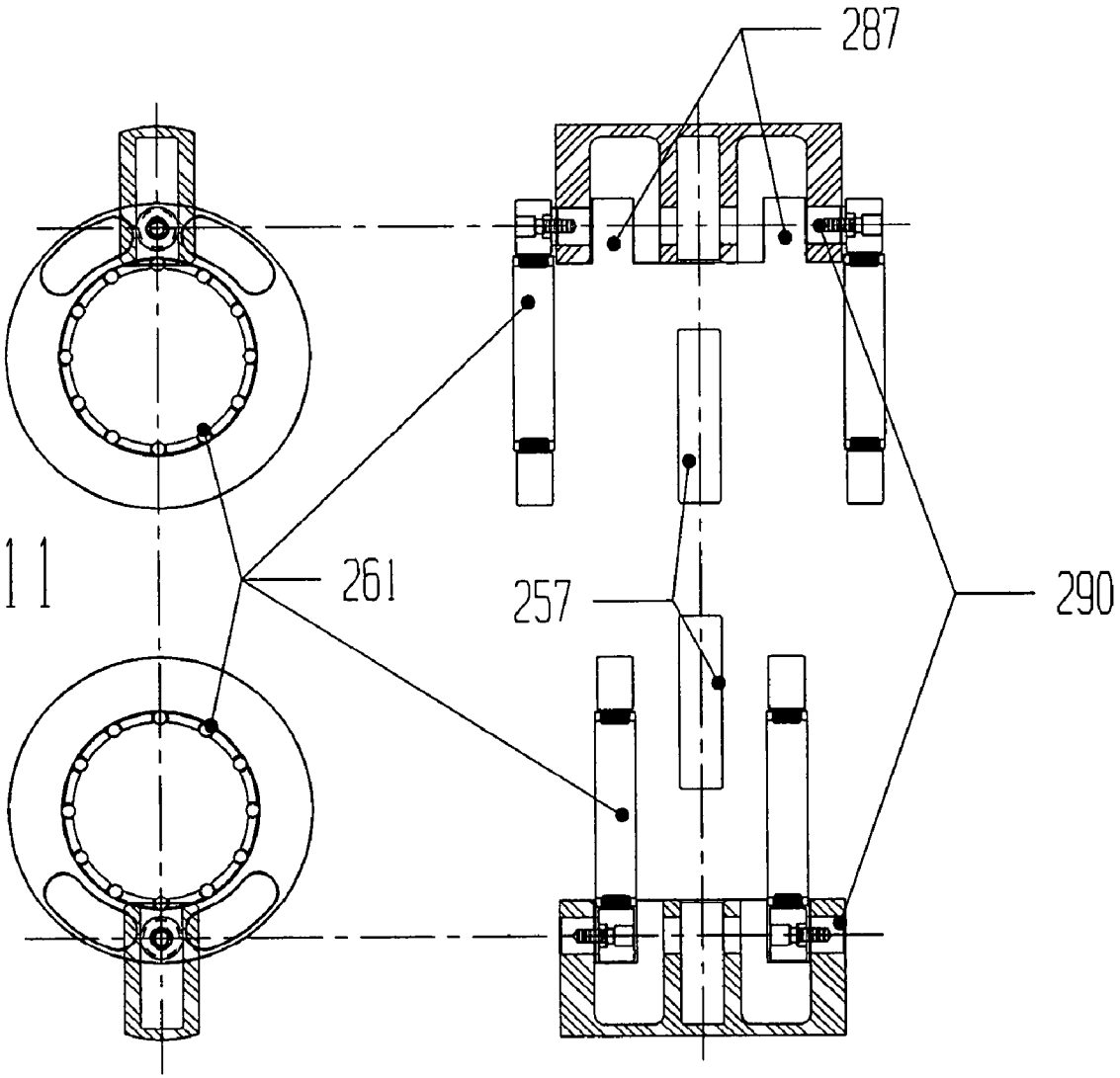
FIG. 11 shows yet another example of the DuoVane apparatus embodiment shown in FIG. 5*a* through FIG. 9.

FIGS. 10 and 11 illustrate yet another embodiment also similar to the other DuoVane embodiments described above. The difference in the embodiment shown in FIGS. 10 and 11 as compared to, say, FIGS. 8 and 9, is that the roller bearings 261 and bearing rings 280 straddle the vanes 285 (on each of the vane ends) and thus eliminate the overhang of stub axles 270 shown in FIG. 9. This embodiment not only stiffens the mechanism, but also shortens the machine somewhat. Also, the four vane bearing rings 280 equipped with balance voids 282 are all identical. Note as well, that the extensions 286*a* of endplates 286 (only one endplate is shown) provide the inner race for the bearings 261, much as shown in FIG. 7 with bearing mounts 265. Also, as illustrated in the foregoing embodiments, the axle vane positioning rods 257 are used to keep the vanes centered within the endplates 286. Finally, note that cross-slots 287 in vanes 285 are present to accommodate clearance for the in-board set of vane bearing rings 280.

As previously discussed in regard to the MonoVane machine, the rotating vane/vane glider ring assemblies must be dynamically balanced about their center of rotation. In the case of the DuoVane machine two sets of rotating assemblies must reside with one another in a cooperative fashion. This is achieved by providing a vane axle pass-through void 275 as shown in FIGS. 8 and 9, so that the second vane 251 can simultaneously receive accurate radial and axial position control and to insure collective dynamic balance of the rotating vane assemblies that is required for proper machine operation.

FIG. 10*a* shows yet another example of the DuoVane apparatus embodiment shown in FIG. 5*a* through FIG. 9, FIGS. 10*b* and 10*c* show a front view of the rotating vane assembly and the vane counter balance, respectively, shown in FIG. 10*a* from one side and FIGS. 10*d* and 10*e* show a front view of the rotating vane assembly and the vane counter balance, respectively, shown in FIG. 10*a* from an opposite side.

In connection with achieving dynamic machine balance, as shown in FIGS. 8, 9, 10 and 11 the 'hot dog'—shaped voids 276, 277 and 282 (virtually any accommodating void shape would do) are present to counter-balance vane 251 and its companion vane axle stubs 270 and 271. While the shaped voids 276 and 277 are shown as having a 'hot dog' shape, voids having alternative shapes may be substituted. These voids 276 and 277 are sized and located to insure that the outer rotating assembly, axially speaking, the one spanning the inner rotating assembly, renders the collective center of gravity very close to the actual rotational axis of the rotating assembly, thus canceling any centripetal out-of-balance forces. Voids, although the voids may be somewhat different, are also required in the glider rings of the 'inner' rotating assembly. These are shown specifically in FIG. 9 as voids 276 which are, in this illustration, more pervasive (larger) than void 277 the vane axle pass through voids 275. This is because the pass-through void 275 increases the mass void required to dynamically balance the axially inner rotating vane subassembly.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A positive displacement apparatus comprising:

a stator housing having an interior bore therethrough;

a first and a second endplate connected to the stator housing at each end of the interior bore;

a rotor having a rotor shaft located in the interior bore, wherein one end of the rotor shaft is connected to an external power source for rotating the rotor within the interior bore;

a rotor centering device for centering the rotor with respect to the stator housing to prevent the rotating rotor from contacting the interior bore and the first and second endplates;

a rotating vane assembly having at least one vane; and a vane centering device having axial positioning control rods for connecting the rotating vane assembly to the rotor shaft and centering the at least one vane with respect to the rotor, wherein the rotor centering device controls a radial position of the rotating vane assembly and the vane centering device controls an axial position of the rotating vane assembly to prevent contact of the at least one vane, at all times during operation of the positive displacement apparatus, with the stator housing interior bore and the first and second endplates.

2. The apparatus of claim 1, wherein said rotor centering device comprises:

a bearing assembly for centralizing the rotor within the interior bore.

3. The apparatus of claim 1, wherein said rotor centering device comprises:

roller bearing for controlling the radial position of the rotor with respect to the stator housing; and roller thrust bearing for controlling the rotor's axial position with respect to the stator housing.

4. The apparatus of claim 1, wherein said vane centering device comprises:

a control rod connecting the rotating vane assembly with the rotor shaft, wherein as the at least one vane rotates the radial and axial position of the at least one vane is controlled.

5. The apparatus of claim 4, wherein the vane centering device further comprises:

a dynamic counter balance to balance the rotating at least one vane to insure that the rotating at least one vane is dynamically balanced about its center of gravity.

6. The apparatus of claim 1, wherein the rotating vane assembly comprises:

a first vane; and a second vane positioned approximately 180° from the first vane, wherein as the first vane and the second vane rotate the second vane blocks a noise pulse inherent to an incomplete emptying of the volume at a discharge valve assembly to provide a quieter apparatus.

7. The apparatus of claim 6, wherein the vane centering device comprises:

a first and a second control rod connecting the first vane and the second vane, respectively, to the rotor shaft, a dynamic counter balance to balance the rotating first and second vane to insure that the rotating first and second vane are dynamically balanced about a center of gravity.

8. The apparatus of claim 1, wherein said positive displacement device is used in a fuel cell applications for a transportation vehicle, wherein said fuel cell application is selection from a group comprising a hydrogen recirculator, a cathode air compressor and a dual air/fuel compressor.

9. A system for controlling a repetitive internal motion to prevent moving parts from contacting non-moving parts of an apparatus comprising:

a stator housing having a bore therethrough and a first and a second endplate connected to each end of the stator bore to form a chamber;

a rotor assembly centrally located within the chamber with respect to the stator housing;

a vane assembly including a vane and a balance connected with the vane to balance the vane about a center of gravity during rotation, the vane assembly controllably connected with the rotor assembly, wherein the central position of the rotor assembly controls a radial position of the vane assembly and the connection of the vane assembly with the rotor assembly controlling the axial position of the vane assembly to prevent the vane assembly, at all times during operation of the positive displacement apparatus, from contacting the chamber during rotation.

10. The system of claim 9, wherein the rotor assembly comprises:

a rotor having a shaft; and a bearing connecting the rotor with the stator bore for controlling the position of the rotor with respect to the chamber.

11. The system of claim 10, wherein said vane assembly comprises:

a dynamic counter balance connected with the vane to dynamically balance the vane about a center of gravity during rotation; and a control device for axially anchoring the vane to the rotor shaft for controlling an axial position of the vane assembly during rotation.

12. The system of claim 10 wherein said vane assembly comprises:

a counter balance vane connected approximately 180° from the leading vane; and a control device for axially anchoring the leading vane and the counter balance vane to the rotor shaft for controlling an axial position of the vane assembly during rotation.

13. The system of claim 12, further comprising:

a dynamic counter balance to balance the vane and the counter balance vane during rotation to insure that the leading and counter balance vanes are dynamically balanced about a center of gravity.

* * * * *